US011850715B2

(12) United States Patent
Wolf et al.

(10) Patent No.: US 11,850,715 B2
(45) Date of Patent: Dec. 26, 2023

(54) METHOD FOR OPERATING A DRIVING-IN DEVICE

(71) Applicant: HILTI AKTIENGESELLSCHAFT, Schaan (LI)

(72) Inventors: Iwan Wolf, Untervaz (CH); Joaquin Herrero Fernandez, St. Gallen (CH); Joerg Stamm, Sennwald (CH); Mario Grazioli, Chur (CH)

(73) Assignee: HILTI AKTIENGESELLSCHAFT, Schaan (LI)

( * ) Notice: Subject to any disclaimer, the term of this patent is extended or adjusted under 35 U.S.C. 154(b) by 73 days.

(21) Appl. No.: 16/483,635

(22) PCT Filed: Mar. 19, 2018

(86) PCT No.: PCT/EP2018/056805
§ 371 (c)(1),
(2) Date: Aug. 5, 2019

(87) PCT Pub. No.: WO2018/172242
PCT Pub. Date: Sep. 27, 2018

(65) Prior Publication Data

US 2020/0030954 A1 Jan. 30, 2020

(30) Foreign Application Priority Data

Mar. 20, 2017 (EP) ..... 17161823

(51) Int. Cl.
*B25C 1/06* (2006.01)
*B25C 1/00* (2006.01)

(52) U.S. Cl.
CPC ..... *B25C 1/06* (2013.01); *B25C 1/00* (2013.01); *B25C 1/008* (2013.01)

(58) Field of Classification Search
CPC .. B25C 1/00; B25C 1/06; B25C 1/008; B25C 5/1689
USPC ..... 227/2
See application file for complete search history.

(56) References Cited

U.S. PATENT DOCUMENTS 6,796,476 B2 * 9/2004 Birk ..... B25C 1/008 227/10
6,892,919 B2 * 5/2005 Higuchi ..... B25C 5/1689 227/131
6,918,522 B2 * 7/2005 Song ..... B25C 5/1689 227/8

(Continued)

FOREIGN PATENT DOCUMENTS

EP 2537640 A2 12/2012
GB 2442580 A * 4/2008 ..... B25C 5/15

(Continued)

OTHER PUBLICATIONS

International Bureau, International Search Report in International Application No. PCT/EP2018/056805, dated Jun. 4, 2018.

*Primary Examiner* — Joshua G Kotis
(74) *Attorney, Agent, or Firm* — Leydig, Voit & Mayer, Ltd.

(57) ABSTRACT

A method for operating a driving-in device for fastening elements comprises a motor operating according to a particular pattern when there are no more fastening elements in a magazine of the driving-in device.

17 Claims, 3 Drawing Sheets

(56) References Cited

U.S. PATENT DOCUMENTS

| | | | | |
|---|---|---|---|---|
| 6,955,281 | B1 * | 10/2005 | Wei | B25C 5/1689 227/120 |
| 7,240,817 | B2 * | 7/2007 | Higuchi | B25C 5/1689 227/110 |
| 8,701,956 | B2 * | 4/2014 | Takemura | B25B 23/06 227/3 |
| 8,857,692 | B2 * | 10/2014 | Shima | B25C 1/06 227/2 |
| 10,786,891 | B2 * | 9/2020 | Noguchi | B25C 1/041 |
| 2008/0110652 | A1 * | 5/2008 | Wen | B25C 5/1689 173/1 |
| 2008/0179371 | A1 * | 7/2008 | Gardner | B25C 5/15 227/1 |
| 2009/0255972 | A1 | 10/2009 | Shima et al. | |
| 2010/0294824 | A1 * | 11/2010 | Takemura | B25C 1/04 227/3 |
| 2012/0325886 | A1 | 12/2012 | Adachi et al. | |
| 2013/0320067 | A1 * | 12/2013 | Gregory | B25C 5/162 227/139 |

FOREIGN PATENT DOCUMENTS

| | | | |
|---|---|---|---|
| JP | 2003136431 | A1 | 5/2003 |
| JP | 2010012580 | A1 | 1/2010 |
| JP | 2013006237 | A1 | 1/2013 |

* cited by examiner

METHOD FOR OPERATING A DRIVING-IN DEVICE

CROSS-REFERENCE TO RELATED APPLICATIONS

This patent application is the U.S. National Stage of International Patent Application No. PCT/EP2018/056805, filed Mar. 19, 2018, which claims the benefit of European Patent Application No. 17161823.4, filed Mar. 20, 2017, which are each incorporated by reference.

TECHNICAL FIELD

The application relates to a method for operating a drive-in device for fastening elements.

BACKGROUND OF THE INVENTION

Devices of this kind generally comprise a drive-in element for driving in a fastening element that is arranged in a drive-in channel, and a drive means for the drive-in element. In the case of devices comprising a magazine, the fastening elements are successively transported into the drive-in channel, using a transport means. When all the fastening elements in the magazine are used up without a user of the drive-in device being aware of this, the user will initially attempt to perform a drive-in procedure, and will reload further fastening elements only after identifying the empty magazine. It is therefore desirable to operate a drive-in device such that the time required for unsuccessful drive-in attempts of this kind is reduced.

BRIEF SUMMARY OF THE INVENTION

In the case of a method for operating a drive-in device for fastening elements comprising a drive-in channel, a drive-in element which is intended for driving a fastening element arranged in the drive-in channel into a substrate, a drive means which is intended for driving the drive-in element onto the fastening element arranged in the drive-in channel, the drive means comprising a motor, a magazine for fastening elements, a transport means which is intended for successively transporting fastening elements, provided in the magazine, into the drive-in channel, and a detection means for querying whether and/or how many fastening elements are present in the magazine, the object is achieved in that the motor is operated in accordance with a standard mode if the detection means detects a specified minimum number of fastening elements in the magazine, and in that the motor is operated in accordance with a deviating, special mode if the detection means does not detect any fastening elements in the magazine or detects a number of fastening elements in the magazine that is below the specified minimum number.

Owing to the deviation of the special mode from the standard mode, a user of the drive-in device immediately identifies that the fastening elements are immediately used up or will be used up following the next drive-in process, and the magazine has to be filled. The user preferably identifies this acoustically and/or haptically.

According to an advantageous embodiment, the special mode differs from the standard mode by a temporal spacing following an event that triggers the operation of the motor. The event triggering the operation of the motor is preferably a conclusion of a drive-in process of the drive-in device, activation of the drive-in device, or raising of the drive-in device from a substrate.

According to an advantageous embodiment, the special mode differs from the standard mode by a temporal duration of the operation of the motor, by a speed of the motor, and/or by a deviating sequence of individual operating phases having a different temporal spacing and/or different duration and/or different speed of the motor.

According to an advantageous embodiment, the drive-in device comprises a contact means for querying whether the work tool is in contact with a substrate, the contact means being located in a contact position when the work tool is in contact with a substrate. The contact means preferably permits driving of the drive-in element onto the fastening element only in the contact position.

According to an advantageous embodiment, the motor is operated in order to transfer the drive means into a state ready for drive-in operations, proceeding from which state the drive-in element is driven towards the fastening element. The drive-in device preferably comprises a mechanical energy storage means, the motor being operated in order to charge the mechanical energy storage means.

According to an advantageous embodiment, the motor is operated in order to drive the drive-in element towards the fastening element.

According to an advantageous embodiment, the motor is an electric motor that is supplied with electrical energy from an electrochemical energy storage means.

According to an advantageous embodiment, the detection means detects the presence of a fastening element at a specified location in the magazine or the drive-in channel.

According to an advantageous embodiment, the transport means comprises a slide for the fastening elements in the magazine, the detection means detecting a position of the slide.

According to an advantageous embodiment, the detection means performs the query regarding whether and/or how many fastening elements are present in the magazine in a capacitive, inductive, magnetic, optical, acoustic or electromechanical manner.

BRIEF DESCRIPTION OF THE SEVERAL VIEWS OF THE DRAWING(S)

Embodiments of a device for driving a fastening element into a substrate will be explained in greater detail in the following, on the basis of examples and with reference to the drawings. In the drawings:

FIG. 1 schematically shows the structure of a drive-in device,

DETAILED DESCRIPTION OF THE INVENTION

Figure 1:
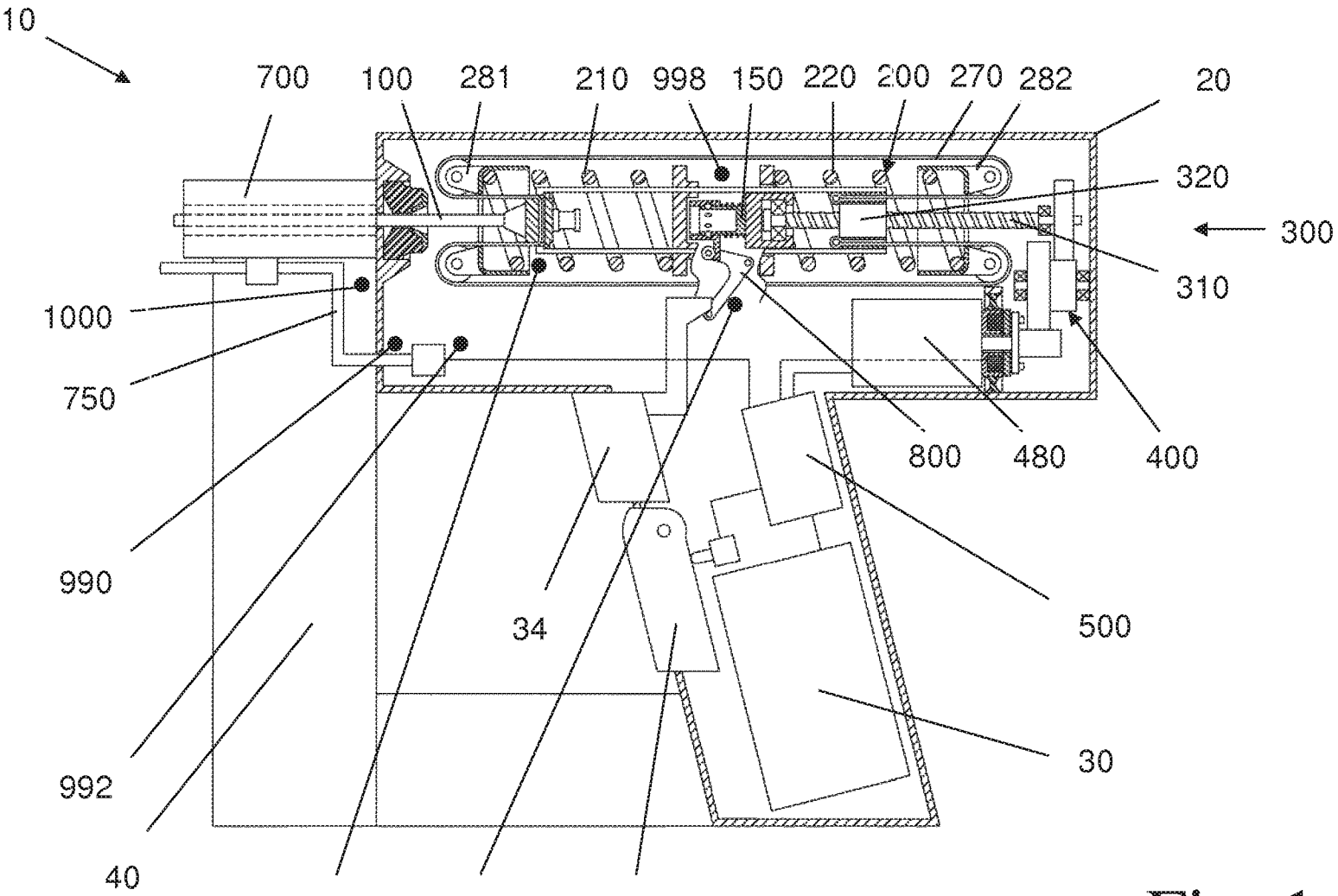

FIG. 1 is a schematic view of a drive-in device 10. The drive-in device 10 comprises a housing 20 in which a drive-in element 100, designed as a piston, and a drive means for the drive-in element 100, are accommodated. The drive means comprises a coupling means 150 that is held closed by means of a retaining element designed as a detent 800, a spring 200 comprising a front spring element 210 and a rear spring element 220, a pulley block 260 comprising a force deflector designed as a belt 270, a front pulley bracket 281 and a rear pulley bracket 282, a spindle drive 300 comprising a spindle 310 and a spindle nut 320, a transmission 400, a motor 480, and a control means 500.

The drive-in device 10 further comprises a drive-in channel 700 for the fastening elements, and a contact means 750. The contact means permits driving of the drive-in element 100 onto the fastening element only in the contact position. The drive-in device 10 further comprises a magazine 40 for fastening elements and a transport means which is intended for successively transporting fastening elements, present in the magazine 40, into the drive-in channel 700. Furthermore, the housing 20 comprises a handle 30 on which a manual switch 35 is arranged. The control means 500 communicates with the manual switch 35 and with a plurality of sensors 990, 992, 994, 996, 998, 1000 in order to detect the operating state of the drive-in device 10. The sensors 990, 992, 994, 996, 998, 1000 each comprise a Hall probe which detects the movement of a magnet armature (not shown) that is arranged on, in particular fastened to, the element to be detected in each case.

The guide channel sensor 990 detects a forwards movement of the contact means 750 which indicates that the guide channel 700 has been removed from the drive-in device 10. The contact sensor 992 detects a backwards movement of the contact means 750 which indicates that the drive-in device 10 is in contact with a substrate. The pulley bracket sensor detects a movement of the front pulley bracket 281 which indicates whether the spring 200 is pre-tensioned. The detent sensor 996 detects a movement of the detent 800 which indicates whether the coupling means 150 is held in the closed state thereof. The spindle sensor 998 detects whether the spindle nut 320 or a return rod, fastened to the spindle nut 320, is in the rearmost position thereof. Finally, a detection means 1000 designed as a slide sensor detects whether a slide, arranged in the magazine 40, is in the uppermost position thereof in FIG. 1, in which position no fastening elements are arranged in the magazine.

After a fastening element has been driven forwards, i.e. towards the left in the drawing, into a substrate by means of the drive-in element 100, the drive-in element 100 is located in the drive-in position thereof. The front spring element 210 and the rear spring element 220 are in the slackened state, in which they do in fact still have some residual tension. The front pulley bracket 281 is in the frontmost position thereof in the operating procedure, and the rear pulley bracket 282 is in the rearmost position thereof in the operating procedure. The spindle nut 320 is located at the front end of the spindle 310. Owing to the spring elements 210, 220 that may be slackened to a residual tension, the belt 270 is substantially unloaded.

As soon as the control means 500 had identified, by means of a sensor, that the drive-in element 100 is in the setting position thereof, the control means 500 triggers a return process in which the drive-in element 100 is conveyed into the starting position thereof. For this purpose, the motor 480 rotates the spindle 310 in a first rotation direction, by means of the transmission 400, such that the rotation-resistant spindle nut 320 is moved backwards.

In this case, the return rods engage in the return studs of the drive-in element 100 and thus likewise convey the drive-in element 100 backwards. In this case, the drive-in element 100 carries along the belt 270, as a result of which the spring elements 210, 220 are not tensioned, however, because the spindle nut 320 likewise carries along the belt 270 towards the rear, and in this case releases the same amount of belt length over the pulleys of the rear pulley bracket 282 as the piston draws in between the pulleys of the front pulley bracket 281. The belt 270 thus remains substantially unloaded during the return process.

The drive-in element 100 is then located in the starting position thereof, and the coupling plug-in portion thereof is coupled with the coupling means 150. The front spring element 210 and the rear spring element 220 are still in the respective slackened states thereof, the front pulley bracket 281 is in the frontmost position thereof, and the rear pulley bracket 282 is in the rearmost position thereof. The spindle nut 320 is located at the rear end of the spindle 310. Owing to the slackened spring elements 210, 220, the belt 270 is still substantially unloaded.

If the drive-in device is now raised from the substrate, such that the contact means 750 is shifted forwards relative to the drive-in channel 700, the control means 500 triggers a tensioning process in which the spring elements 210, 220 are tensioned. For this purpose, the motor rotates the spindle 310 in a second rotation direction that opposes the first rotation direction, by means of the transmission 400, such that the rotation-resistant spindle nut 320 is moved forwards. In this case, the coupling means 150 retains the coupling plug-in portion of the drive-in element 100, such that the belt length that is drawn in between the rear pulleys by means of the spindle nut 320 cannot be released by the piston. The pulley brackets 281, 282 are therefore moved towards one another and the spring elements 210, 220 are tensioned.

The drive-in element 100 is then again located in the starting position thereof, and the coupling plug-in portion thereof is coupled with the coupling means 150. The front spring element 210 and the rear spring element 220 are tensioned, the front pulley bracket 281 is in the rearmost position thereof, and the rear pulley bracket 282 is in the frontmost position thereof. The spindle nut 320 is located at the front end of the spindle 310. The belt 270 deflects the tensioning force of the spring elements 210, 220 at the pulleys of the pulley brackets 281, 282 and transfers the tensioning force to the drive-in element 100 which is retained by the coupling means 150, against the tensioning force. The drive-in device is now ready for a drive-in process. As soon as a user pulls the trigger 34, the coupling means 150 releases the drive-in element 100, which then transmits the tensioning energy of the spring elements 210, 220 to a fastening element and drives the fastening element into the substrate.

Figure 2:
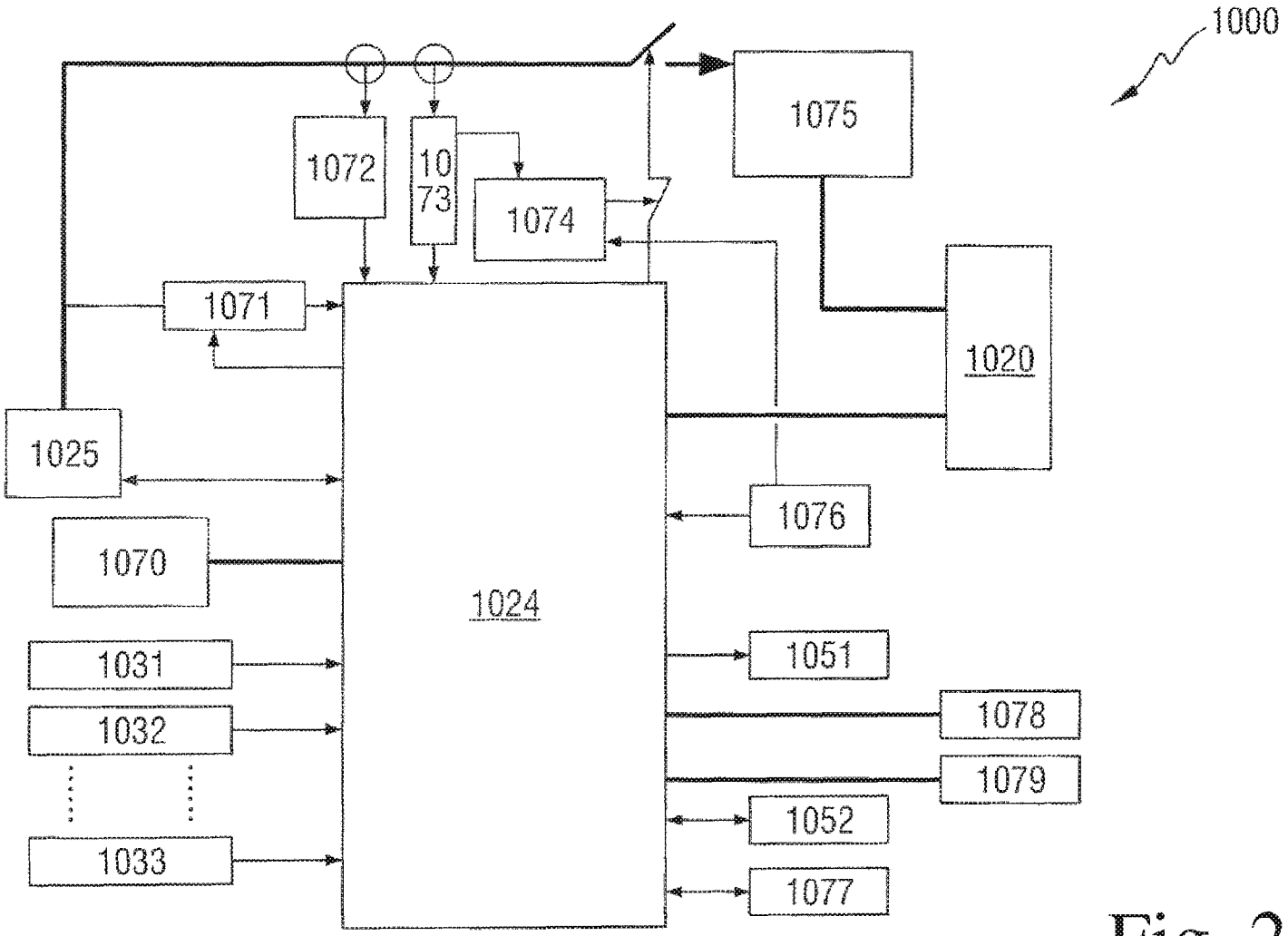
FIG. 2 is a plugging diagram of a drive-in device.

FIG. 2 is a simplified view of the control assembly of the drive-in device. A central rectangle indicates the control means 1024. As is indicated by arrows, the switching and/or sensor means 1031 to 1033 deliver information or signals to the control means 1024. A manual or main switch 1070 of the drive-in device is connected to the control means 1024. A double arrow indicates that the control means 1024 communicates with the battery 1025. Further arrows and a rectangle indicate latching 1071.

Further arrows and rectangles 1072 and 1073 indicate a voltage measurement and a current measurement. A further rectangle 1074 indicates a disconnection means. A further rectangle indicates a B6-bridge 1075. In this case, this is a 6-pulse bridge circuit comprising semiconductor elements for controlling the electric drive motor 1020. This is preferably actuated by means of driver components, which are in turn preferably actuated by a controller. In addition to the appropriate actuation of the bridge, a further advantage of integrated driver components of this kind is that they bring the switching elements of the B6-bridge into a defined state in the case of an undervoltage occurring.

A further rectangle 1076 indicates a temperature probe which communicates with the disconnection means 1074 and the control means 1024. A further arrow indicates that the control means 1024 outputs information to the display 1051. A further double arrow indicates that the control means 1024 communicates with the interface 1052 and with a further service interface 1077.

A further rectangle 1078 indicates a fixing brake which is actuated by the control means 1024. The fixing brake 1078 is used to slow movements when relaxing the energy storage means 1010 and/or to keep the energy storage means in the tensioned or charged state. For this purpose, the fixing brake 1078 can interact with a belt drive or transmission (not shown).

A further rectangle 1079 indicates a detection means for querying whether and/or how many fastening elements are present in the magazine. If the detection means 1079 detects a specified minimum number of fastening elements in the magazine, the control means 1024 operates the motor in accordance with a standard mode in order to transfer the drive means into the state thereof in which it is ready for drive-in operations. For example, operation of the motor is started immediately after the drive-in device has been raised from a substrate following a drive-in process. If, in contrast, the detection means 1079 does not detect any fastening elements in the magazine or detects a number of fastening elements therein that is below the specified minimum number, the control means 1024 operates the motor in accordance with a special mode that deviates from the standard mode. For example, operation of the motor is started only following a delay, after the drive-in device has been raised from a substrate following a drive-in process. Alternatively, the motor is initially operated at an increased or reduced speed, after the drive-in device has been raised from a substrate following a drive-in process.

Figure 3:
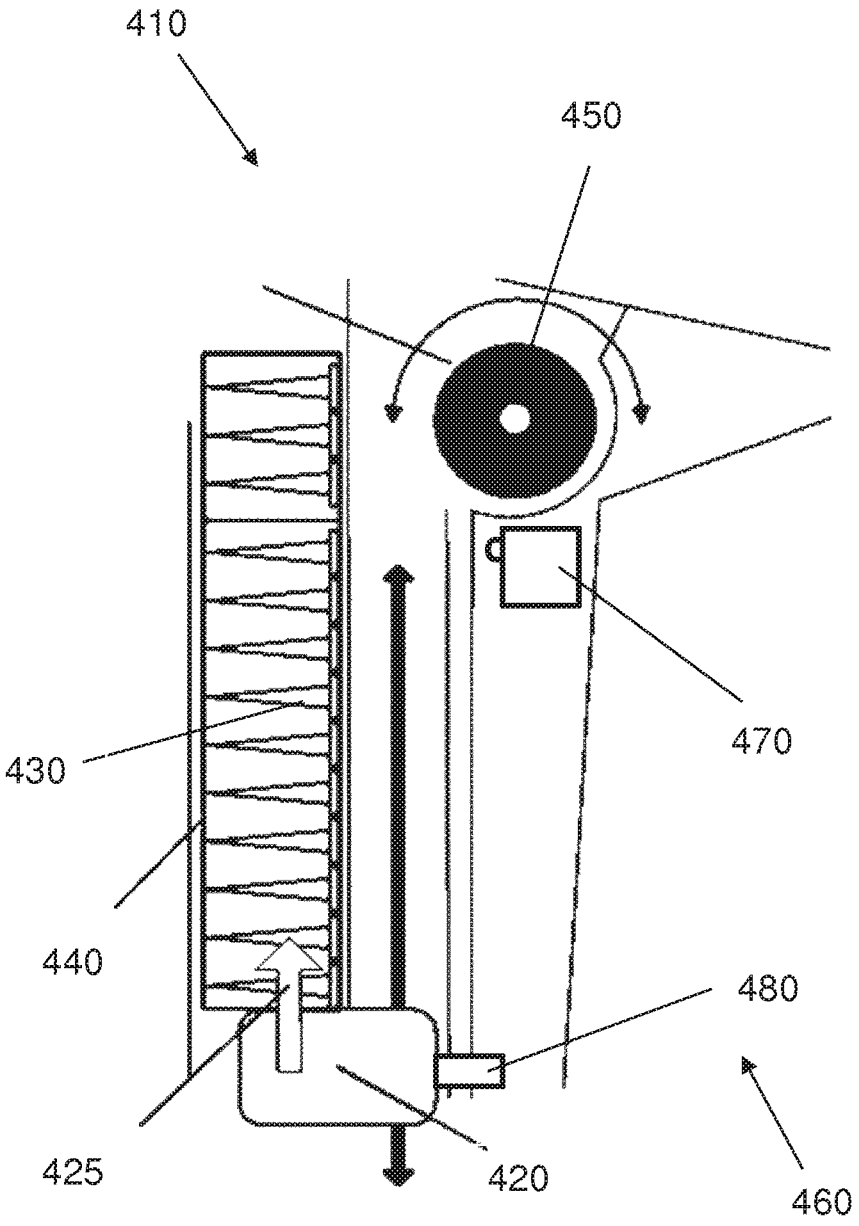
FIG. 3 is a schematic view of a detail of a drive-in device.

FIG. 3 shows a detail of a drive-in device 410 according to a further embodiment. The drive-in device comprises a magazine 440 and a transport means comprising a slide 420 for transporting fastening elements 430 in the magazine 440 in a transport direction 425, and a spring element 450 which is designed as a scroll spring and applies a force to the slide 420 and thus to the fastening elements 430, in the direction of a drive-in channel (not shown) of the drive-in device 410.

The drive-in device 410 furthermore comprises a detection means 460, which detects a position of the slide 420. The detection means 460 comprises an electrical switch 470 which is closed by an actuation element 480 of the slide 420 when the slide 420 has reached the uppermost position thereof in FIG. 3. This is preferably the case when the last fastening element present in the magazine 440 is transported into the drive-in channel.

In an embodiment that is not shown, the detection means performs the query regarding whether and/or how many fastening elements are present in the magazine in a capacitive, inductive, magnetic, optical, acoustic or electromechanical manner.

The invention has been described on the basis of the example of a spring nailer. It is noted, however, that the invention can also be implemented in other manners. In particular, gas, powder, pneumatically, hydraulically or electromagnetically operated drive-in devices can be achieved, in which a drive means comprises a motor that is operated by combustion power, pneumatically, hydraulically or electrically and which is operated within the meaning of the invention, for example in order to return a drive-in element into a starting position following a drive-in process or to drive a fan. The invention can likewise be implemented in a screwdriver, in particular a cordless screwdriver.

The invention claimed is:

1. A method for operating a drive-in device for fastening elements, the drive-in device comprising:

a drive-in channel, a drive-in element for driving a fastening element arranged in the drive-in channel into a substrate, a drive for driving the drive-in element onto the fastening element arranged in the drive-in channel, the drive comprising a rotating motor, a magazine for fastening elements, a transport comprising a slide for successively transporting fastening elements, present in the magazine, into the drive-in channel, and a detector configured to detect whether and/or how many fastening elements are present in the magazine, the method comprising:

operating the motor in a first mode if the detector detects a number of fastening elements in the magazine that is at least a minimum number, operating the motor in a second mode different from the first mode if the detector does not detect any fastening elements in the magazine or detects a number of fastening elements therein that is below the minimum number, acoustically and/or haptically identifying that the fastening elements are used up or will be used up following a next drive-in process based on a deviation of the second mode from the first mode, wherein the deviation comprises a different sequence of individual operating phases of the motor comprising a different operating speed of the motor and at least one of a different temporal spacing and a different temporal duration of the operation of the motor.

2. The method according to claim 1, wherein the deviation of the second mode from the first mode comprises a delay following an event that triggers the operation of the motor.

3. The method according to claim 2, wherein the event triggering the operation of the motor is a conclusion of a drive-in process of the drive-in device, activation of the drive-in device, or raising of the drive-in device from a substrate.

4. The method according to claim 3, wherein the deviation of the second mode from the first mode comprises a different temporal duration of the operation of the motor.

5. The method according to claim 2, wherein the deviation of the second mode from the first mode comprises a different temporal duration of the operation of the motor.

6. The method according to claim 1, wherein the deviation of the second mode from the first mode comprises a different temporal duration of the operation of the motor.

7. The method according to claim 1, wherein the drive-in device comprises a contact comprising a sensor configured to detect whether the device is in contact with a substrate, the contact being located in a contact position when the device is in contact with a substrate.

8. The method according to claim 7, wherein the contact permits driving of the drive-in element onto the fastening element only in the contact position.

9. The method according to claim 1, wherein the motor is operated in order to transfer the drive into a state ready for drive-in operations, proceeding from which state the drive-in element is driven towards the fastening element.

10. The method according to claim 9, wherein the drive-in device comprises a mechanical energy storage, the motor being operated to load the mechanical energy storage.

11. The method according to claim 1, wherein the motor is operated to drive the drive-in element towards the fastening element.

12. The method according to claim 1, wherein the motor is an electric motor that is supplied with electrical energy from an electrochemical energy storage.

13. The method according to claim 1, wherein the detector detects the presence of a fastening element at a specified location in the magazine or the drive-in channel.

14. The method according to claim 1, wherein the detector detects a position of the slide.

15. The method according to claim 1, wherein the detector performs a query regarding whether and/or how many fastening elements are present in the magazine in a capacitive, inductive, magnetic, optical, acoustic or electromechanical manner.

16. The method according to claim 1, wherein the deviation of the second mode from the first mode comprises an increased speed of the motor.

17. The method according to claim 1, wherein the deviation of the second mode from the first mode comprises a reduced speed of the motor.

* * * * *